US007147554B1

(12) United States Patent
Berger

(10) Patent No.: US 7,147,554 B1
(45) Date of Patent: Dec. 12, 2006

(54) HOODED EXHAUST VENT

(76) Inventor: Edwin L. Berger, 115 Albany Ave., Amityville, NY (US) 11701

( * ) Notice: Subject to any disclaimer, the term of this patent is extended or adjusted under 35 U.S.C. 154(b) by 36 days.

(21) Appl. No.: 10/989,752

(22) Filed: Nov. 17, 2004

(51) Int. Cl.
*F24F 7/06* (2006.01)

(52) U.S. Cl. ..... 454/359; 454/353

(58) Field of Classification Search ..... 454/367, 454/359, 353; 52/198, 199
See application file for complete search history.

(56) References Cited

U.S. PATENT DOCUMENTS 4,760,773 A * 8/1988 Pezzulli ..... 454/358
5,199,190 A * 4/1993 Mayer et al. ..... 34/235
5,257,468 A * 11/1993 Lebrun ..... 34/235
5,685,290 A * 11/1997 Collins et al. ..... 126/518
5,722,181 A * 3/1998 Meyer ..... 34/235
5,916,023 A 6/1999 Meyer
6,299,529 B1 * 10/2001 Preston ..... 454/367
6,361,433 B1 * 3/2002 Gray ..... 454/358
6,443,834 B1 * 9/2002 Berger ..... 454/353
6,506,113 B1 * 1/2003 Berger ..... 454/290
6,584,702 B1 * 7/2003 Irey ..... 34/417
6,733,381 B1 * 5/2004 Ploeger ..... 454/366

* cited by examiner

*Primary Examiner*—Derek S. Boles
(74) *Attorney, Agent, or Firm*—Myron Amer P.C.

(57) ABSTRACT

A hooded exhaust vent having walls bounding an exhaust opening covered by a guard, in the assembly of which the walls and guard respectively have laterally extending slides urged in sliding movement into slide tracks in the path of the movement to establish a sliding interconnection therebetween.

1 Claim, 2 Drawing Sheets

HOODED EXHAUST VENT

The present invention relates generally to improvements in a hooded exhaust vent in which, more particularly, the improvements facilitate the attachment and detachment of a guard used as a covering over the exit or exhaust opening of the vent.

EXAMPLE OF THE PRIOR ART

It is already known from U.S. Pat. No. 5,916,023 for "Hooded Exhaust Vent", issued on Jun. 29, 1999 and assigned to Deflecto Corporation that a precaution in the use of a dwelling exhaust vent requires an attachment thereto of a guard, in the nature of a screen, to prevent the nesting of birds within the chamber bounded by the walls serving the "hooded" function of the exhaust vent, as well as to prevent entry into the interior of the dwelling of squirrels and like animals. The air being vented contains lint, which gathers on the guard mounted in the exiting path to atmosphere, thus requiring frequent detachment of the guard preparatory to the removal of the lint therefrom, and reinstatement back as a cover over the vent exhaust opening. The current practice, as exemplified by the '023 patent and all other known patents is to use a snap-fit of cooperating male and female structures in attaching and detaching the vent and guard to each other. While generally useful for the purposes intended, because the guard and peripheral wall areas bounding the exit opening are of plastic construction material, the frequency of removal and replacement often inadvertently results in a rupture of the plastic construction material and replacement of the exhaust vent.

Broadly, it is an object of the present invention to overcome the foregoing and other shortcomings of the prior art.

More particularly, it is an object to replace snap-fit interconnection with a sliding-fit interconnection, the latter significantly obviating the stress and strain on the plastic construction material of the structural features involved, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view of a hooded exhaust vent with a snap-in guard according to the prior art of U.S. Pat. No. 5,916,023;

As background to the present invention is U.S. Pat. No. 5,916,023 issued to Meyer on Jun. 29, 1999 for "Hooded Exhaust Vent", the construction and operating mode of which is well known and is incorporated by this reference in this application as if fully set forth herein pursuant to MPEP 2163.07(b).

Figure 1:
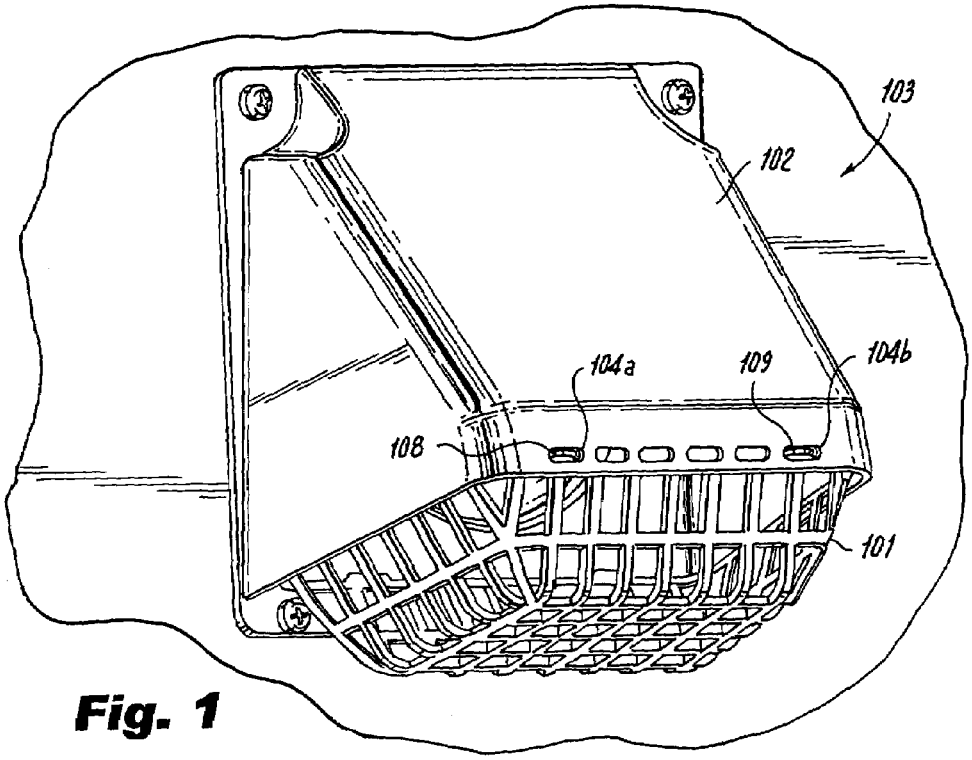
Fig. 1 (Prior Art)

More particularly, in the prior art said "Hooded Exhaust Vent" illustrated in FIG. 1, there is shown a hood 102 covering a dwelling exhaust vent 103 in which the hood opening to atmosphere is in turn covered by a guard 101 having snap-in tabs 104*a* and 104*b* which snap in place into cooperating apertures 108 and 109 to hold the guard in place. It will be understood that rear tabs snap into cooperating rear apertures (not shown) to provide four snap-in sites of connection.

Figure 2:
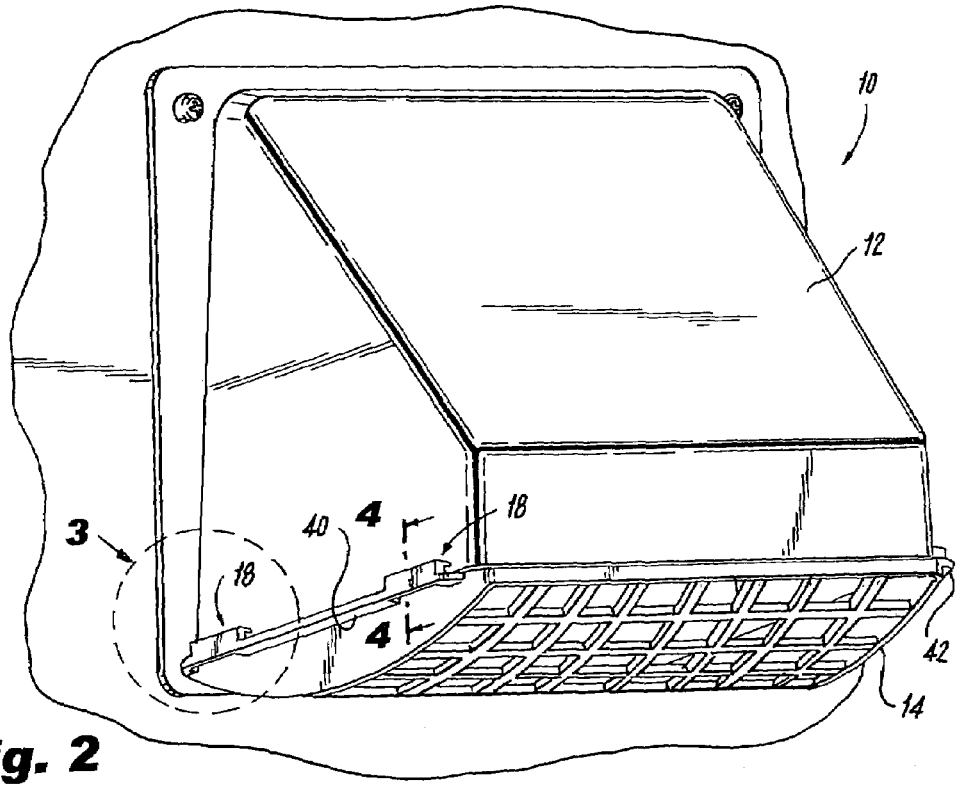
FIG. 2 is similarly a perspective view of a hooded exhaust vent, but with a slide-connected guard according to the present invention.
Figure 3:
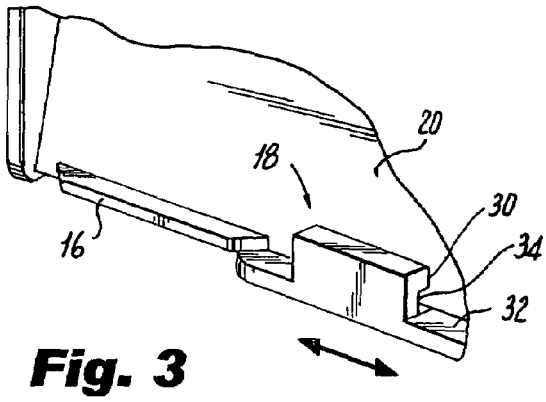
FIG. 3 is a partial perspective view, on an enlarged scale, of the components for establishing a slide connection of the guard, as denoted by arrow 3 of FIG. 2.
Figure 4:
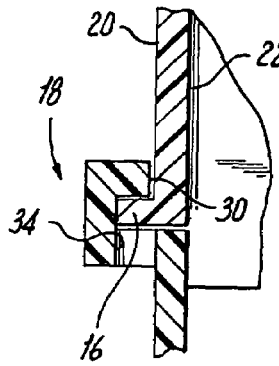
FIG. 4 is an end view, in section, projected from FIG. 3 taken along line 4—4 of FIG. 2.
Figure 5:
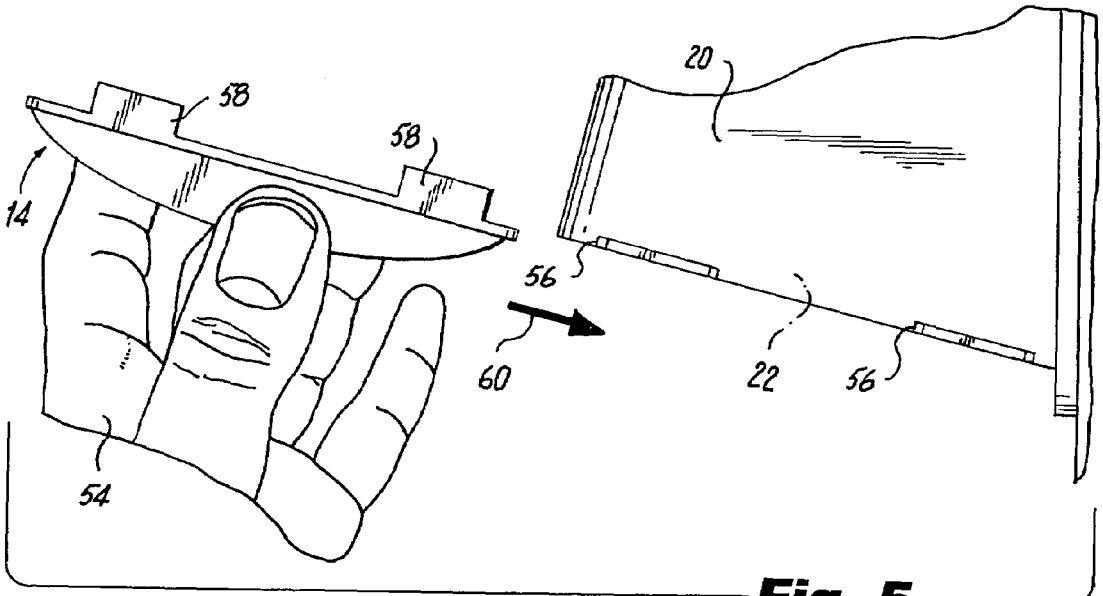
FIG. 5 is a perspective view illustrating an initial position preparatory to establishing the sliding connection.

The hooded exhaust vent of the present invention, generally designated 10, is shown in FIG. 2 having a hood 12 in assembled relation to a guard 14 characterized by projections, individually and collectively designated 16 substituted for the prior art tabs 104*a* and 104*b*, and which cooperate with track length portions, individually and collectively designated 18 substituted for the prior art apertures 108 and 109, it having been found in practice that a slide interconnection rather than a snap-in interconnection minimizes inadvertent rupture of the tabs 104*a*, 104*b* and/or edges bounding the apertures 108, 109. The guard 101 must be frequently disconnected to remove lint, and then in being again connected to the hood, the handing required strains and sometimes ruptures the edges bounding the hood apertures 108, 109. In achieving an interconnection in a sliding mode, as will be subsequently better understood as the description proceeds, the slide projections 16, that track in the track lengths 18 are not subjected to handling or strain that exceeds, what can be tolerated without rupture, the plastic construction material of the hood edge areas 20 which bound the vent opening 22 and the similarly constituted construction material of the slide projections 16.

As readily understood from FIGS. 2–6, the slide track configurations 18 are four in number at each corner and are molded in situ on the hood 14 at the two corner locations illustrated, namely, locations 26 and 28, and each presents a groove 34 bounded between upper and lower laterally extending projections 30 and 32. Sized to be received in a cooperating groove 34 are the noted slide projections 16, said slide projections being molded in situ on the left and right side edges 40 and 42 of the hood 12. The locations of the slide projections and slide track configurations are selected so that, as may be best understood from FIGS. 3, 5 and 6, the guard 14 in the grip of a user 54 can align the rear ends, individually and collectively designated 56, with the front openings, individually and collectively designated 58 into the slide track configurations, a relationship depicted by the arrow designated 60.

Figure 6:
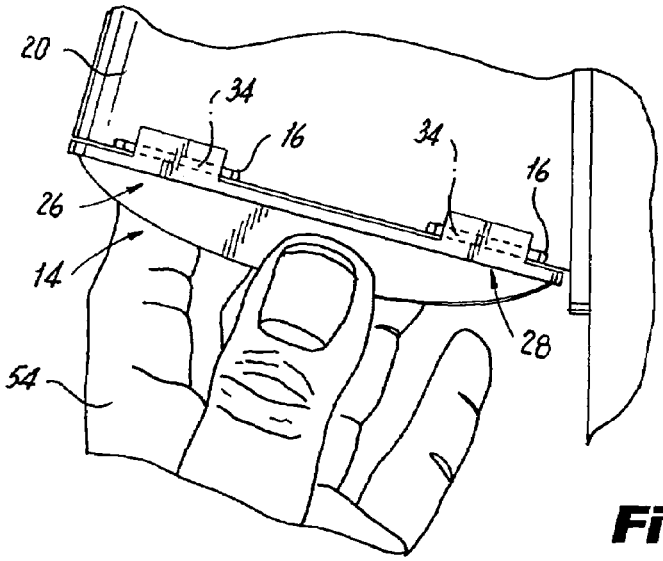
FIG. 6 is similarly a perspective view, but of an ending position thereof.

Proceeding from the alignment at sites 60, the user 54 then manually moves the slide connectors 14 through the openings 58 and into the slide track configurations 18 as shown in FIG. 6, thusly implementing a sliding operating mode which obviates any strain as occurs in a snap-fit prior art mode. In disconnecting the guard 44 from the hood 24 preparatory to removing lint, the sliding operating mode is repeated but in an opposite direction.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An exhaust vent for routing exhaust from a first location within a structure to a second location outside of the structure of a type having a unitary vent hood including a rear wall defining therein an exhaust aperture, a connecting portion positioned around said exhaust aperture for the assembly thereto of an exhaust conduit, a forward wall which in cooperation with said rear wall defines an exit opening;

flow control means disposed over said exhaust aperture and being constructed and arranged for permitting flow therethrough in substantially only an exiting direction, and a unitary guard for covering over said exit opening, said guard including a plurality of first projections for use in an assembly of said guard to said vent hood;

wherein the improvement comprises:

first projections in the nature of slides extending laterally of said vent hood;

second projections in the nature of slide tacks extending laterally of said guard; and operative positions of said slide tracks in urged movement and said slides in said path of movement so as to establish a sliding fit assembly of said guard to said vent hood;

whereby in said assembly a sliding fit is substituted for a snap-fit.

* * * * *